US005544852A

United States Patent [19]

Lee

[11] Patent Number: 5,544,852

[45] Date of Patent: Aug. 13, 1996

[54] MODULAR FORM ASSEMBLY FOR CONCRETE STRUCTURE

[76] Inventor: Wen-Yuan Lee, 7F-3, No.8, Lane 390, Sec.1, Chien-Kang Rd., Tainan City, Taiwan

[21] Appl. No.: 373,853

[22] Filed: Jan. 18, 1995

[51] Int. Cl.[6] ..... E04G 9/03; E04G 11/06; E04G 17/14

[52] U.S. Cl. ..... 249/192; 249/47; 249/196; 249/210; 249/219.2

[58] Field of Search ..... 249/47, 192, 196, 249/219.2, 210, 191, 189, 211, 219.1

[56] References Cited

U.S. PATENT DOCUMENTS

| | | | |
|---|---|---|---|
| 2,964,294 | 12/1960 | Imonetti | 249/219.2 X |
| 3,550,898 | 12/1970 | Ursini et al. | 249/47 X |
| 4,372,522 | 2/1983 | Simeonoff | 249/47 X |
| 4,901,497 | 2/1990 | Lee | 249/196 X |
| 4,957,272 | 9/1990 | Lee | 249/196 |

*Primary Examiner*—Robert J. Warden
*Assistant Examiner*—E. Leigh Dawson
*Attorney, Agent, or Firm*—Birch, Stewart, Kolasch & Birch, LLP

[57] ABSTRACT

A modular form assembly for a concrete structure includes vertical channel pieces coupled detachably side by side to one another, and horizontal reinforcement units interconnected detachably. Each channel piece includes two opposing vertical walls, and an intermediate vertical wall interconnecting the vertical walls and serving as a form wall. Each vertical wall is attached detachably to the adjacent vertical wall to arrange the form walls in a common vertical plane. The reinforcement units are attached detachably to the vertical walls opposite to the form walls so as to keep the form walls in the common vertical plane. Each reinforcement unit includes a horizontal plate, first flanges extending vertically from two opposing sides of the horizontal plate, and second flanges extending vertically from two other opposing sides of the horizontal plate. Each second flange abuts against and is connected detachably to the adjacent second flange.

10 Claims, 9 Drawing Sheets

MODULAR FORM ASSEMBLY FOR CONCRETE STRUCTURE

BACKGROUND OF THE INVENTION

1. Field of the Invention

This invention relates to a form assembly, more particularly to a modular form assembly which has a plurality of vertical channel pieces that can be coupled detachably side by side to one another to constitute a desired dimension of common form plane for forming a concrete structure.

2. Description of the Related Art

The improvement of this invention is directed to a conventional form assembly, as shown in FIG. 1, for forming a concrete structure. The conventional form assembly, which has been disclosed in U.S. Pat. No. 4,957,272, includes vertical form plates (A1), vertical backing frames (A2), and horizontal reinforcement channel members (A3) which are coupled detachably to one another and which are then attached detachably to upper and lower edges of the form plates (A1). The backing frames (A2) are mounted detachably between the horizontal reinforcement channel members (A3) behind the form plates (A1). In order to further reinforce the form plates (A1), the conventional form assembly, when in practical application, further includes several horizontal reinforcement rods (A4), as shown in FIGS. 2 and 3, which are mounted threadably to the backing frames (A2) to press against the rear faces of the form plates (A1) in order to increase the contact areas between the form plates (A1) and the backing frames (A2), thereby preventing deformation of the form plates (A1) during use.

Referring again to FIG. 1, the form plates (A1) have positioning holes (A5) formed therethrough at predetermined positions where, when any two form plates (A1) are located face to face, the positioning holes (A5) can be aligned with each other. In order to maintain two opposite form plates (A1) at a predetermined space into which concrete is poured, the conventional form assembly further includes several positioning bars (not shown), each of which having its two end portions mounted respectively within the aligned positioning holes (A5) of the opposite form plates (A1). In this way, the predetermined space between the opposite form plates (A1) can be maintained.

The drawbacks of the conventional form assembly are as follows:

1. A relatively large number of parts is required, such as the form plates (A1), the backing frames (A2), the reinforcement channel members (A3) and the reinforcement rods (A4), to constitute the conventional form assembly. Thus, it is quite complicated and difficult to assemble or disassemble these parts when in use.

2. Because the dimensions of the form plates (A1) are relatively large, the form plates (A1) can only be applied for forming wider walls, such as partition walls (B1), as shown in FIG. 4. When applying the form plate (A1) to form narrower walls, such as the narrow walls (B3) at the aisles (B2) or at the vent passageway (B4), the form plate (A1) has to be cut to fit the dimensions of the narrow walls (B3). This may result in waste of material. Therefore, bricks are still employed to constitute the narrow walls (B3).

3. To form variable dimensions of partition walls (B1) for use in different floors of a building, some of the form plates (A1) have to be cut so as to allow the assembly of the modified and original form plates (A1) to obtain the desired partition walls (B1). This results in waste of time and material. In addition, due to the change in the dimensions of the form plates (A1), alignment of the positioning holes (A5) at the opposite form plates (A1) cannot be maintained. Accordingly, several additional positioning holes (A5) have to be provided again in some of the form plates (A1) so as to mount the positioning bars. At the same time, the original positioning holes (A5) have to be filled. Thus, it is quite inconvenient to assemble the modified and original form plates (A1).

SUMMARY OF THE INVENTION

Therefore, the main objective of the present invention is to provide a modular form assembly which includes a plurality of vertical channel pieces that can be coupled easily and detachably side by side to one another in order to constitute a desired dimension of a common form plane for forming a concrete structure.

Another objective of the present invention is to provide a modular form assembly which further includes a plurality of horizontal reinforcement units that can be connected detachably to one another and that can be attached detachably to the coupled channel pieces so as to reinforce and keep the coupled channel pieces in their common form plane during use.

According to this invention, a modular form assembly includes a plurality of vertical channel pieces which are coupled detachably side by side to one another, and a plurality of horizontal reinforcement units which are connected detachably to one another.

Each of the channel pieces includes two opposing vertical walls, and an intermediate vertical wall which interconnects the vertical walls and which serves as a form wall. The vertical walls of the channel pieces abut against and are attached respectively and detachably to any adjacent two of the vertical walls so as to arrange the form walls in a side-to-side contiguity, thereby placing the form walls in a common vertical plane.

The reinforcement units abut against and are connected detachably to the vertical walls opposite to the form walls so as to keep the form walls in the common vertical plane. Each of the reinforcement units includes a horizontal plate which has two opposing sides parallel to the form walls and two other opposing sides parallel to the vertical walls. Each of the reinforcement units further includes first flanges which extend vertically from the opposing sides of the horizontal plate, and second flanges which extend vertically from other opposing sides of the horizontal plate. Each of the second flanges abuts against and is connected detachably to the adjacent one of the second flanges. The vertical walls and the form wall of each of the channel pieces are formed integrally with each other.

In addition, each of the channel pieces has a rib formed on one of the vertical walls thereof, and a groove formed in the other one of the vertical walls. Accordingly, the channel pieces are interlocked via the ribs and the grooves.

Preferably, each of the reinforcement units further includes a cover plate which opposes the horizontal plate and which is spanned on and secured to the first and second flanges. Each of the reinforcement units has four corners adjacent to a respective one of the second flanges thereof. Each of the reinforcement units has recessed portions in areas adjacent to the four corners where the first flanges meet the horizontal plate and the cover plate. Accordingly, the adjacent second flanges can be connected to each other by means of bolt elements which can pass through the adjacent second flanges from the recessed portions.

BRIEF DESCRIPTION OF THE DRAWINGS

Other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
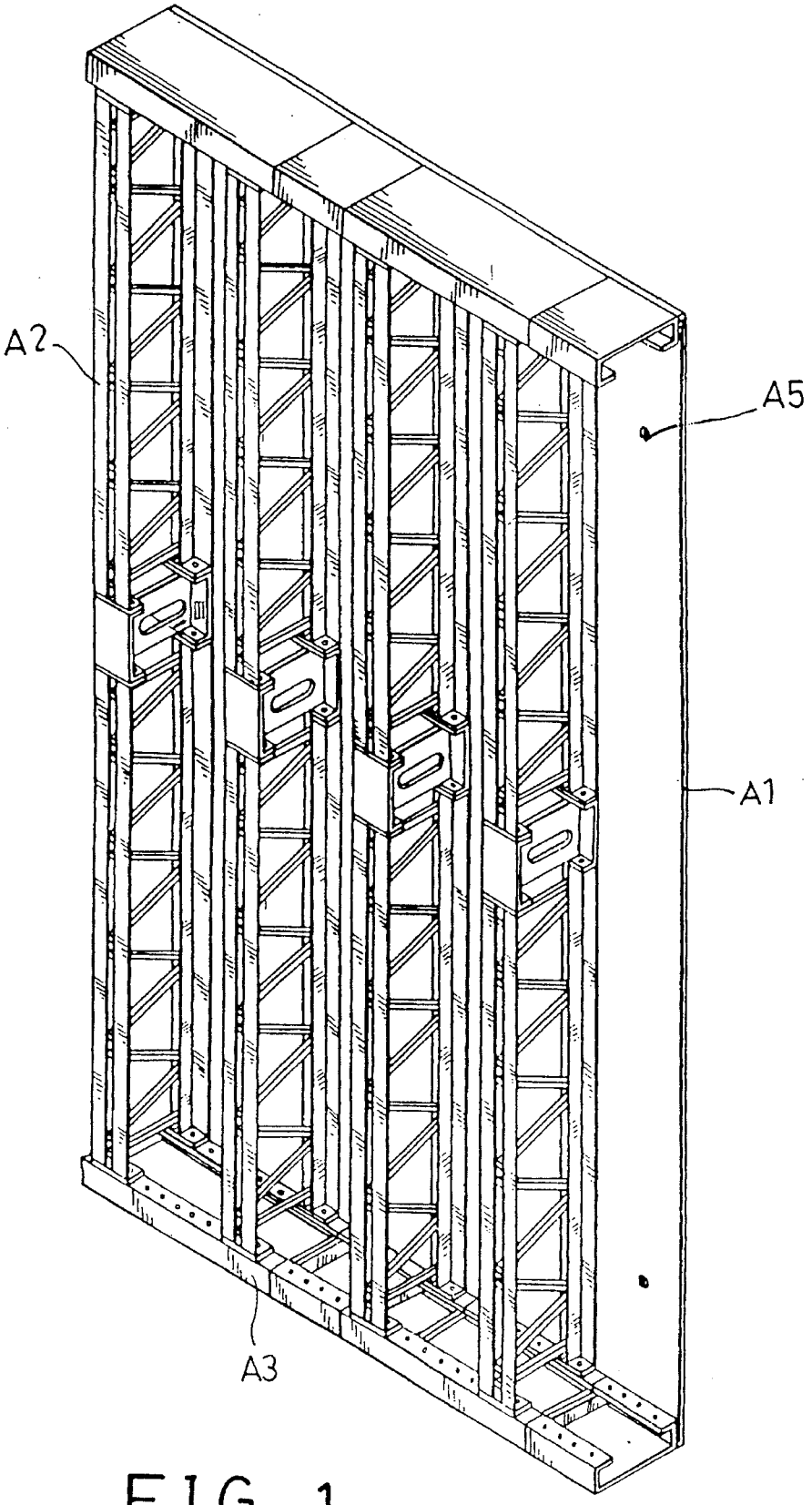
FIG. 1 (PRIOR ART)
FIG. 1 is a perspective view showing a conventional form assembly.
Figure 2:
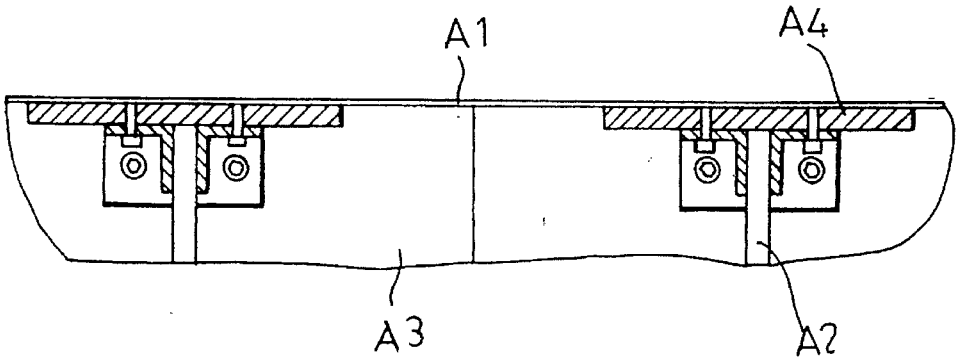
FIG. 2 (PRIOR ART)
FIG. 2 is a schematic view illustrating reinforcement rods of the conventional form assembly.
Figure 3:
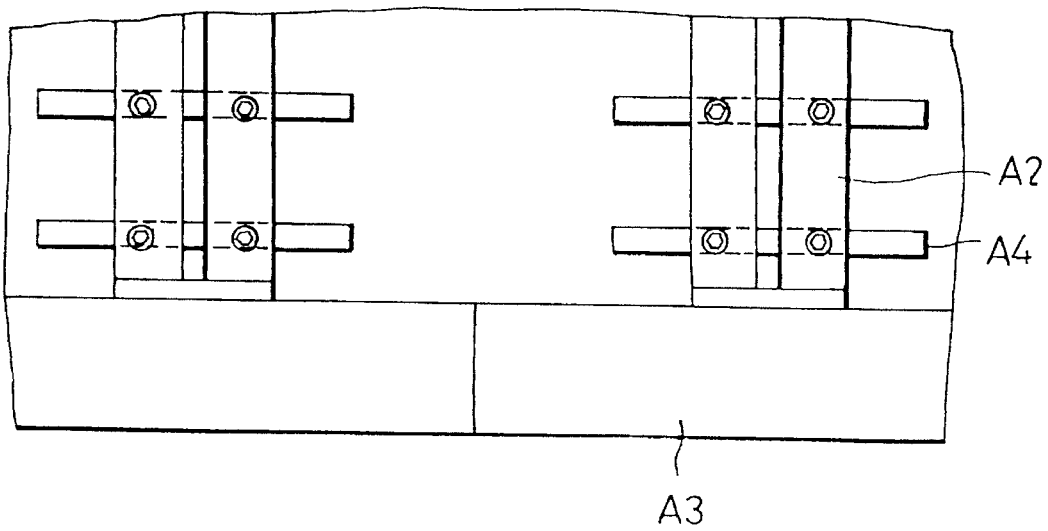
FIG. 3 (PRIOR ART)
FIG. 3 is an elevational side view showing the reinforcement rods of the conventional form assembly.
Figure 4:
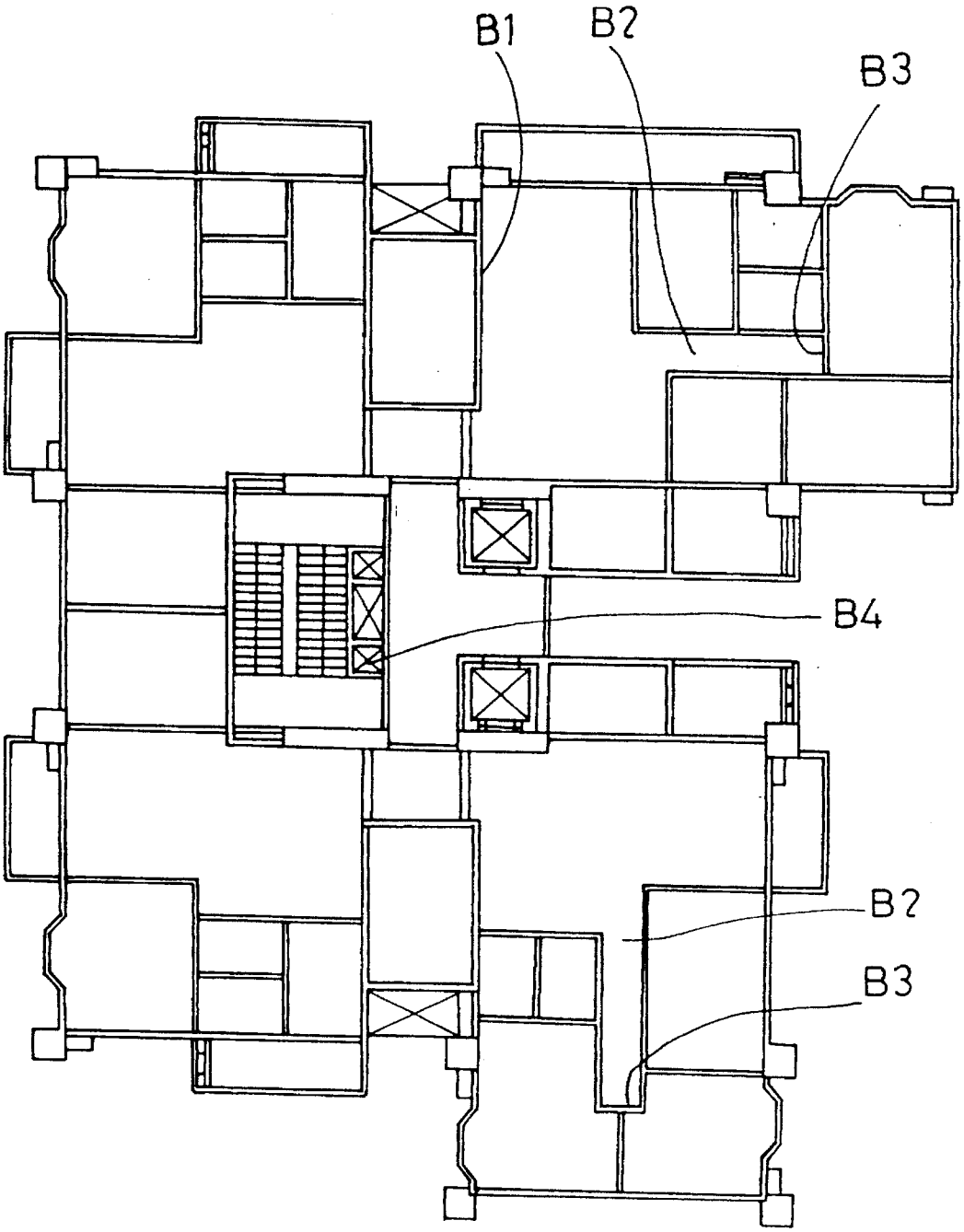
FIG. 4 (PRIOR ART)
FIG. 4 illustrates a floor layout of a building which uses the conventional form assembly in its partition walls.
Figure 5:
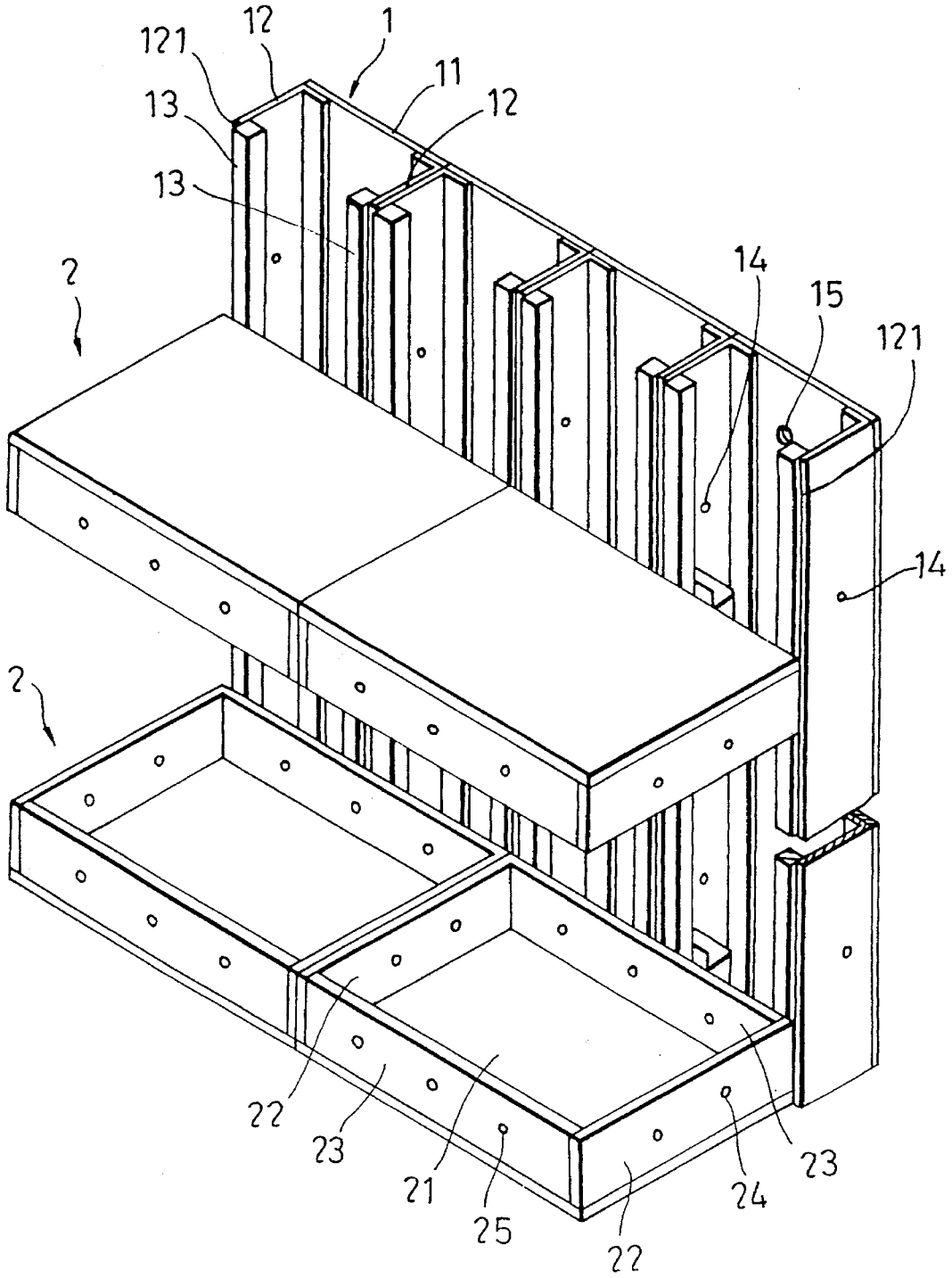
FIG. 5 is a perspective view showing the first preferred embodiment of a modular form assembly of this invention.
Figure 8:
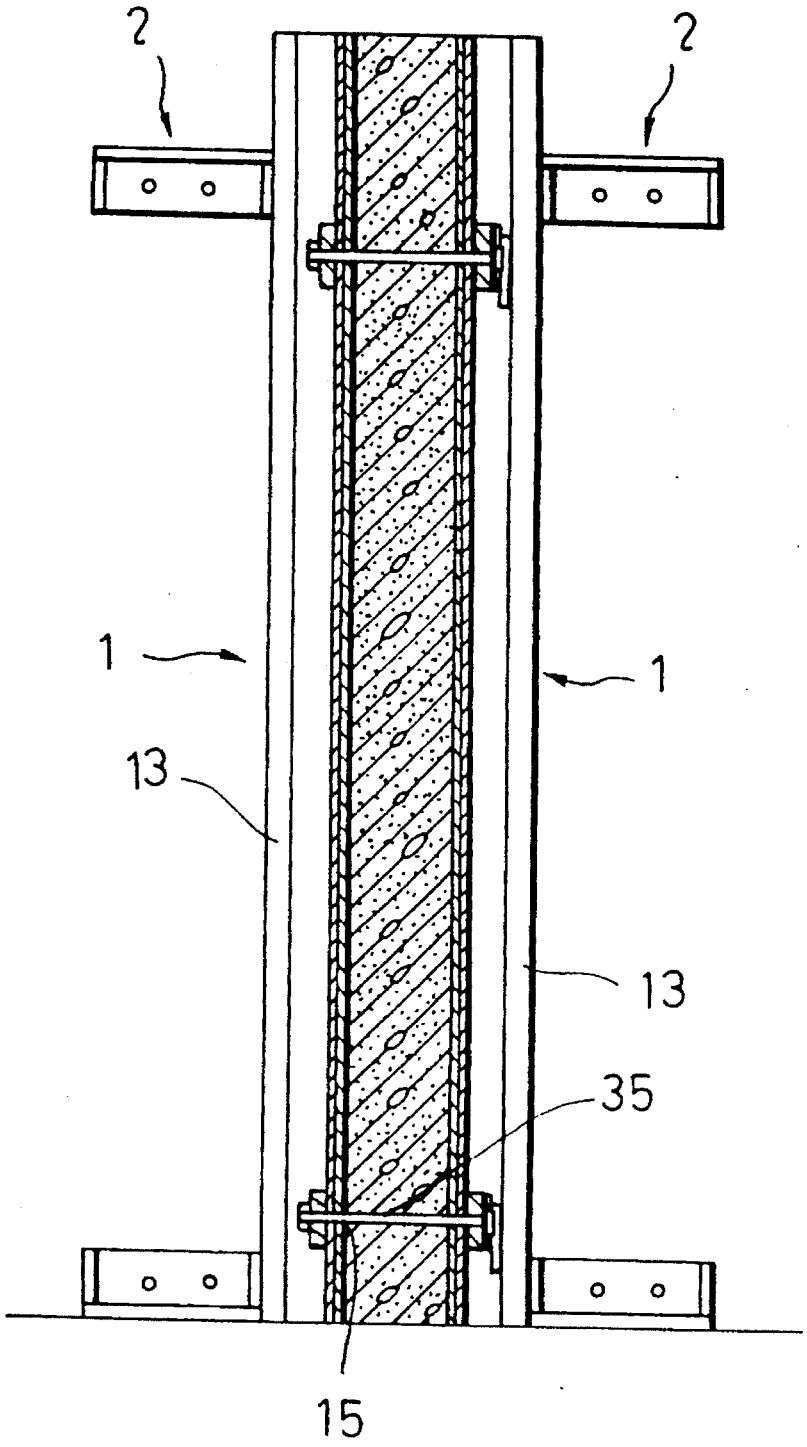
FIG. 8 is a schematic view illustrating how the modular form assembly is applied to form a concrete structure in accordance with this invention.

Referring to FIGS. 5 and 8, the first preferred embodiment of a modular form assembly according to this invention includes a plurality of vertical channel pieces 1 which are coupled detachably side by side to one another, and a plurality of horizontal reinforcement units 2 which are connected detachably to one another. The connected horizontal reinforcement units 2 are then attached detachably to the vertical channel pieces 1 in a manner that will be described in the following paragraphs.

Figure 6:
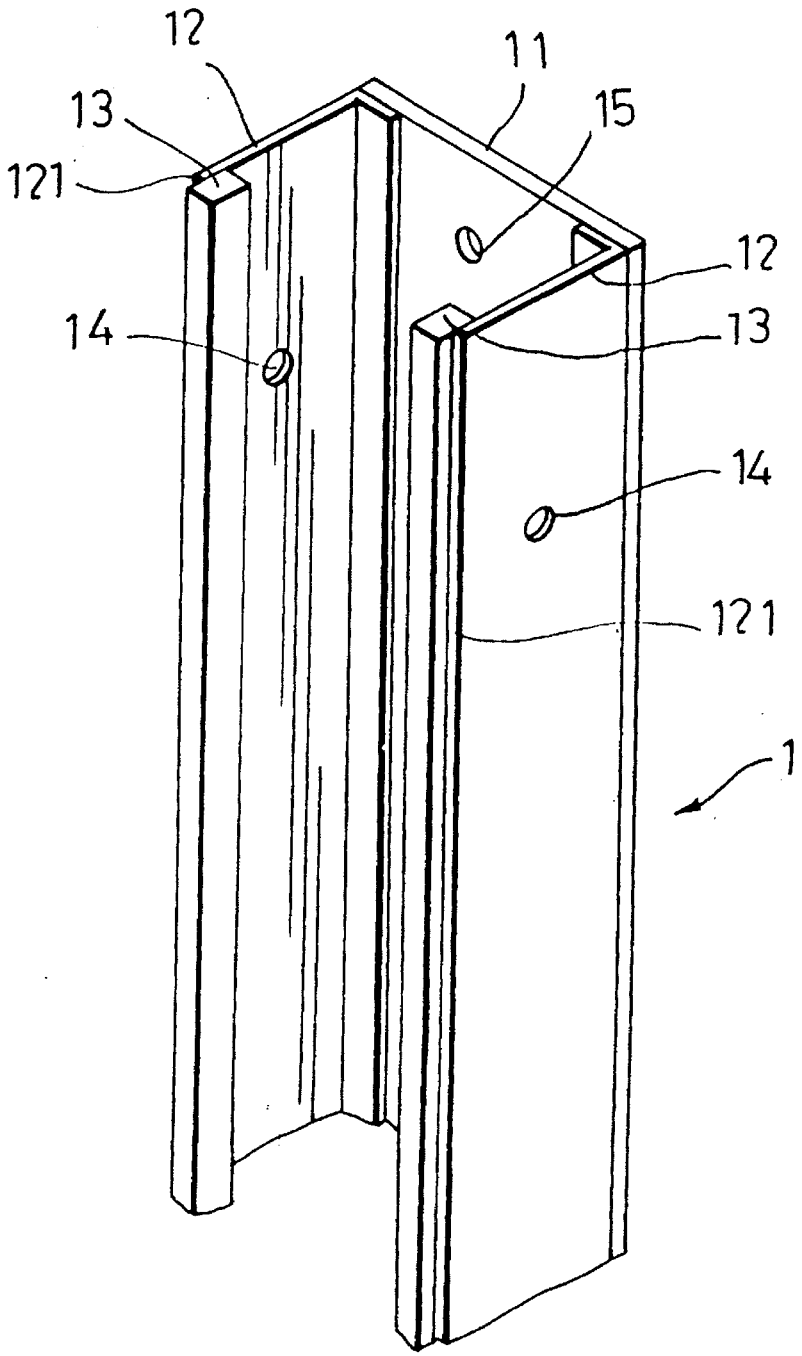
FIG. 6 is a perspective view showing a vertical channel piece of the modular form assembly according to this invention.
Figure 7:
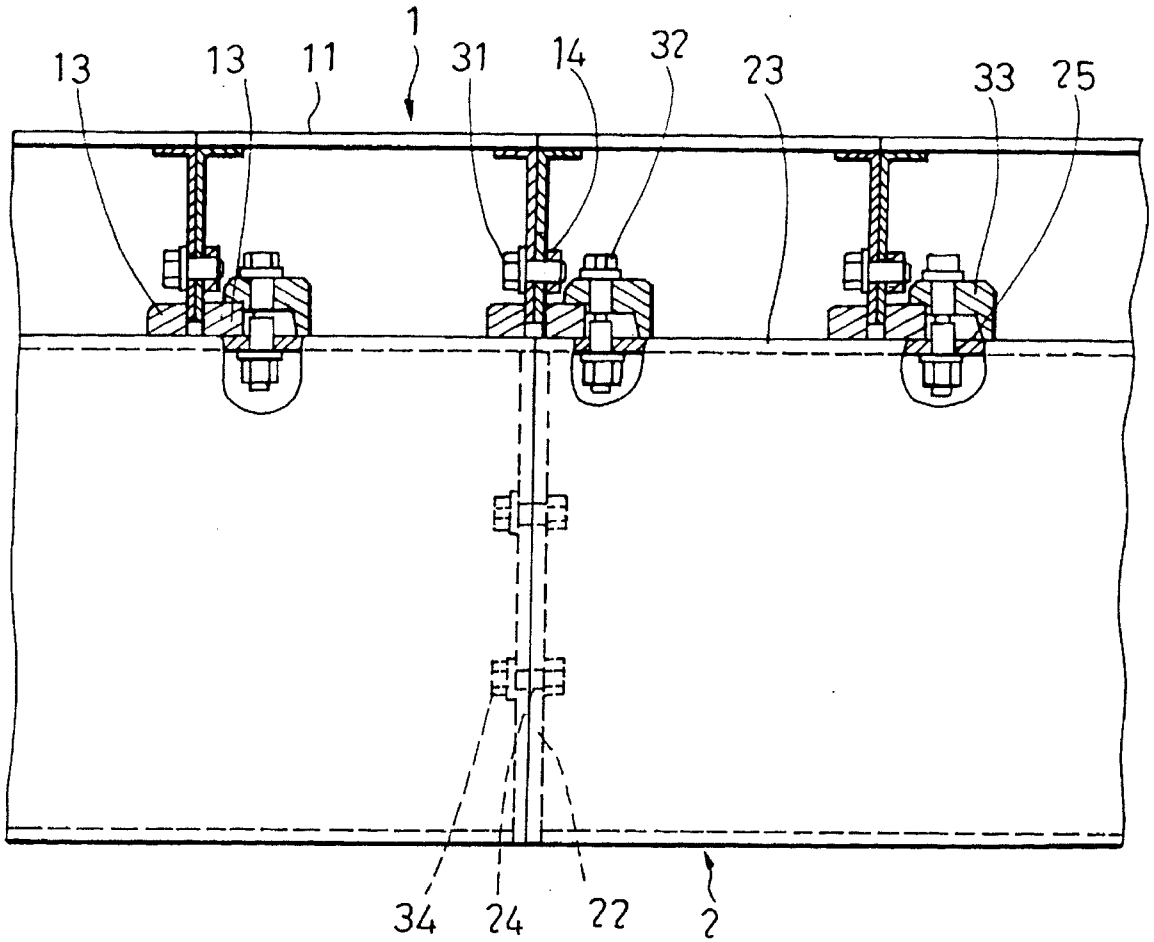
FIG. 7 is a schematic view illustrating how horizontal reinforcement units of the modular form assembly are attached detachably to the vertical channel pieces in accordance with this invention.

Referring to FIGS. 5 and 6, each of the channel pieces 1 includes two opposing vertical walls 12 and an intermediate vertical wall which interconnects the vertical walls 12. The intermediate vertical wall serves as a form wall 11. To interconnect the channel pieces 1, the vertical walls 12 of the channel pieces 1 abut against and are then attached respectively and detachably to any adjacent two of the vertical walls 12 by means of bolt elements 31, as shown in FIG. 7, that extend through aligned holes 14 on the attached vertical walls 12. In this way, the form walls 11 can be arranged in a side-to-side contiguity so as to place the form walls 11 in a common vertical plane.

Then, two common vertical planes are located face to face at a predetermined space, as shown in FIG. 8, into which concrete is poured for forming a concrete structure. In addition, some of the vertical walls 11 have positioning holes 15 (see FIGS. 5 and 6) formed therethrough at predetermined positions where the positioning holes 15 on some of the opposite vertical walls 11 can be aligned with each other in order to mount positioning bars 35 within any aligned positioning holes 15 in a known manner. Thus, the predetermined space between the opposite common vertical planes can be maintained when the concrete is poured thereinto.

The channel pieces 1 can be manufactured in different dimensions. For example, the vertical walls 11 can be made to have widths of 100 mm, 120 mm, 140 mm, 160 mm, 180 mm and 200 mm. Accordingly, channel pieces 1 with different dimensions can be applied to form walls with desired dimensions, such as the narrow walls at the narrow aisles or at the vent passageways. In addition, the vertical walls 12 of the channel pieces 1 can further function as reinforcing parts to avoid vertical bend of the form walls 11 during use.

Referring again to FIGS. 5 and 7, each of the channel pieces 1 further includes a pair of elongated blocks 13 secured respectively to two opposite inner sides of the vertical walls 12 adjacent to the rear end faces 121 of the vertical walls 12. Each of the reinforcement units 2 includes a horizontal plate 21 which has two opposing sides parallel to the form walls 11 and two other opposing sides parallel to the vertical walls 12. Each of the reinforcement units 2 further includes two first flanges 23 which extend respectively and vertically from the opposing sides of the horizontal plate 21, and two second flanges 22 which extend respectively and vertically from the other opposing sides of the horizontal plate 21. The second flanges 22 of the reinforcement units 2 abut against and are connected detachably to any adjacent two of the second flanges 22 by means of bolt elements 34 (see FIG. 7) which extend through aligned holes 24 on the abutting second flanges 22. In this way, the reinforcement units 2 can be coupled detachably to one another. One of the first flanges 23 of each of the reinforcement units 2 abuts against and is connected detachably to the elongated blocks 13 of the vertical walls 12 by means of bolt elements 32 and washer elements 33 (see FIG. 7) in such a manner that each bolt element 32 extends through the corresponding washer element 33 to engage a hole 25 in the first flange 23. Each washer element 33 is retained by the corresponding elongated block 13 and depresses against the corresponding first flange 23 by means of a respective one of the bolt elements 32 in a known manner so as to fix the reinforcement units 2 on the channel pieces 2, thereby maintaining the form walls 11 in their common vertical plane and avoiding horizontal bend of the form walls 11 during use. Since the modular form assembly of this invention includes only two main parts, the channel pieces and the reinforcement units, it is quite easy and convenient to install or dismantle the modular form assembly.

It is noted that, if the vertical walls 12 are manufactured to have a larger thickness, the first flanges 23 can be connected directly to the rear end faces 121 of the vertical walls 12 by means of bolt elements without the need for using the washer elements 33 and the elongated blocks 13. Each of the bolt elements extends through the first flange 23 of the corresponding vertical wall 12 to engage the corresponding rear end face 121 in a known manner so as to fix the reinforcement units 2 to the channel pieces 1.

Figure 9:
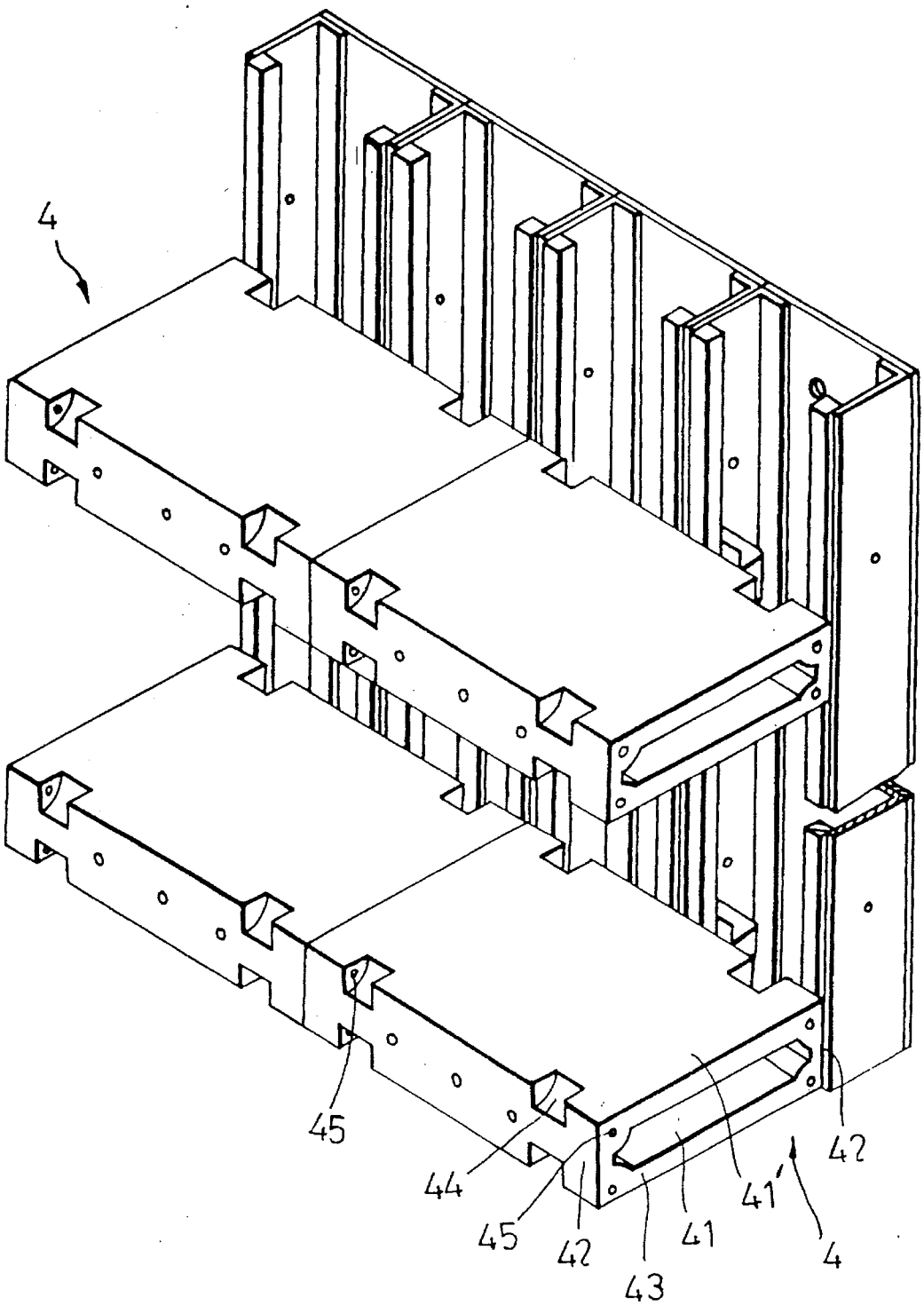
FIG. 9 is a perspective view showing the second preferred embodiment of a modular form assembly of this invention.

FIG. 9 shows the modified reinforcement units 4 of the second preferred embodiment of a modular form assembly according to this invention. As shown, each of the modified reinforcement units 4 includes a horizontal plate 41, two first flanges 42 formed respectively and vertically on two opposite sides of the horizontal plate 41, two second flanges 43 formed respectively and vertically on two other opposite sides of the horizontal plate 41, and a cover plate 41' spanning and secured to the first and second flanges 42, 43 opposite to the horizontal plate 41. One of the first flanges 42 of each of the reinforcement units 4 is attached detachably to the vertical walls of the channel pieces in a manner similar to that taught in the first preferred embodiment. The additional cover plates 41' can further provide a reinforcing effect for the channel pieces during use. Each of the reinforcement units 4 further has recessed portions 44 in areas, adjacent to eight corners of the box-like reinforcement unit 4, where the first flanges 42 meet the horizontal plate 41 and the cover plate 41'. Accordingly, the recessed portions 44 can facilitate installation of bolt elements (not shown) within any aligned holes 45 of the adjacent second flanges 43 so as to interconnect the adjacent second flanges 43.

Figure 10:
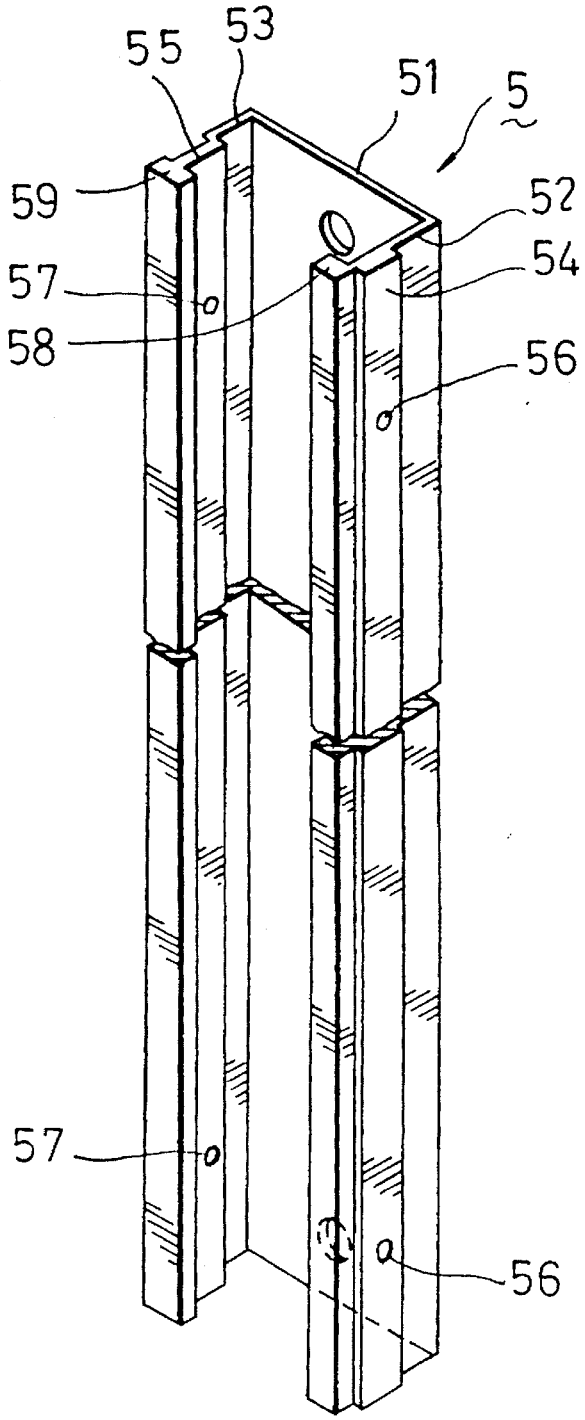
FIG. 10 is a perspective view showing a modified vertical channel piece of the modular form assembly according to the third preferred embodiment of this invention.

FIG. 10 shows a modified channel piece 5 of the third preferred embodiment of a modular form assembly according to this invention. As shown, the intermediate form wall 51 and the opposite vertical walls 52, 53 of the modified channel piece 5 are formed integrally with each other and can be made of aluminum or an aluminum alloy. The modified channel piece 5 further has a rib 54 formed on the vertical wall 52, and a groove portion 55 formed in the vertical wall 53. Accordingly, the rib 54 of each of the channel pieces 5 can engage the groove portion 55 of the adjacent one of the channel pieces 5 so as to facilitate interlocking of the channel pieces 5 during assembly. In addition, the rib 54 still has holes 56 formed therethrough and aligned respectively with holes 57 in the groove portion 55. Accordingly, the rib 54 and the groove portion 55 can be further positioned by means of bolt elements in a manner similar to that described beforehand. The vertical walls 52, 53 still have elongated blocks 58, 59 formed integrally on the rear end faces thereof for abutting against and connecting the first flange of the corresponding reinforcement unit (not shown).

It is noted that, to avoid adhesion of partly dry concrete to the form walls which affects the appearance of the concrete structure when dismantling the modular form assembly, each of the form walls is coated with a layer of protective film, such as lacquer, in order to facilitate removal of the form walls from the concrete structure. In this invention, the protective film is made of an epoxy resin.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangement.

I claim:

1. A modular form assembly comprising:

a plurality of vertical channel pieces coupled detachably side by side to one another, each of said channel pieces including two opposing vertical walls, and an intermediate vertical wall which interconnects said vertical walls and which serves as a form wall, said vertical walls of said channel pieces abutting against and being attached respectively and detachably to adjacent two of said vertical walls so as to arrange said form walls in a side-to-side contiguity, thereby placing said form walls in a common vertical plane; and a plurality of horizontal reinforcement units interconnected detachably to each other, said reinforcement units abutting against and being connected detachably to said vertical walls opposite to said form walls so as to keep said form walls in said common vertical plane, each of said reinforcement units including a horizontal plate which has two opposing sides parallel to said form walls and two other opposing sides parallel to said vertical walls, each of said reinforcement units further including first flanges which extend vertically from said opposing sides of said horizontal plate, and second flanges which extend vertically from said other opposing sides of said horizontal plate, each of said second flanges abutting against and being connected detachably to an adjacent one of said second flanges.

2. A modular form assembly as claimed in claim 1, wherein said vertical walls and said form wall of each of said channel pieces are formed integrally with each other.

3. A modular form assembly as claimed in claim 1, wherein each of said channel pieces has a rib formed on one of said vertical walls thereof, and a groove portion formed in the other one of said vertical walls, whereby said channel pieces are interlocked via said ribs and said groove portions.

4. A modular form assembly as claimed in claim 1, wherein said channel pieces are made of aluminum.

5. A modular form assembly as claimed in claim 1, wherein said channel pieces are made of an aluminum alloy.

6. A modular form assembly as claimed in claim 1, wherein each of said form walls is coated with a layer of protective film.

7. A modular form assembly as claimed in claim 6, wherein said protective film is made of an epoxy resin.

8. A modular form assembly as claimed in claim 1, wherein each of said reinforcement units further includes a cover plate which opposes said horizontal plate and which spans on and is secured to said first and second flanges.

9. A modular form assembly as claimed in claim 8, wherein each of said reinforcement units has four corners adjacent to a respective one of said second flanges thereof, each of said reinforcement units having recessed portions in areas adjacent to said four corners where said first flanges meet said horizontal plate and said cover plate, whereby said adjacent second flanges are interconnected to each other by bolt elements which can pass through said adjacent second flanges from said recessed portions.

10. A modular form assembly as claimed in claim 1, wherein at least one of said form walls have positioning holes formed therethrough at predetermined positions.

* * * * *